US006978863B2

(12) United States Patent
Hikita

(10) Patent No.: US 6,978,863 B2
(45) Date of Patent: Dec. 27, 2005

(54) APPARATUS FOR ELEVATOR GROUP CONTROL

(75) Inventor: Shiro Hikita, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 113 days.

(21) Appl. No.: 10/475,900

(22) PCT Filed: May 30, 2002

(86) PCT No.: PCT/JP02/05258

§ 371 (c)(1),
(2), (4) Date: Oct. 24, 2003

(87) PCT Pub. No.: WO03/101873

PCT Pub. Date: Dec. 11, 2003

(65) Prior Publication Data

US 2004/0129502 A1 Jul. 8, 2004

(51) Int. Cl.[7] ..... B66B 1/18
(52) U.S. Cl. ..... 187/382; 187/387; 187/902
(58) Field of Search ..... 187/247, 248, 187/380–389, 902

(56) References Cited

U.S. PATENT DOCUMENTS

| | | | | |
|---|---|---|---|---|
| 5,663,538 | A | 9/1997 | Sakita | |
| 5,865,274 | A | 2/1999 | Kiji et al. | |
| 6,176,351 | B1 * | 1/2001 | Ikeda et al. | 187/387 |
| 6,237,721 | B1 * | 5/2001 | Siikonen | 187/382 |
| 6,273,217 | B1 | 8/2001 | Hikita | |
| 6,293,368 | B1 * | 9/2001 | Ylinen et al. | 187/382 |
| 6,364,065 | B1 | 4/2002 | Hikita | |
| 6,401,874 | B2 * | 6/2002 | Siikonen | 187/382 |
| 6,505,712 | B2 * | 1/2003 | Hattori et al. | 187/382 |
| 6,508,333 | B2 * | 1/2003 | Kostka et al. | 187/382 |

FOREIGN PATENT DOCUMENTS

| | | |
|---|---|---|
| JP | 6-305648 | 1/1994 |
| JP | 8-282926 | 10/1996 |
| JP | 2002-220164 | 8/2002 |

* cited by examiner

*Primary Examiner*—Jonathan Salata
(74) *Attorney, Agent, or Firm*—Leydig, Voit & Mayer, Ltd.

(57) ABSTRACT

In an apparatus for elevator group control which performs group management of a set of elevators, the set consisting of an upper car and a lower car which are disposed in a vertical relation within one elevator shaft and which ascend and descend independently, the floors are classified so that a floor communicating with an entrance of a building is classified as a main floor for the lower car, a floor communicating with an entrance of the building above the main floor for the lower car is classified as a main floor for the upper car, a lower-floor portion of the shaft is classified as a lower-car priority zone, an upper-floor is classified as an upper-car priority zone, and an intermediate-floor portion is classified as a common-use zone of the upper car and the lower car. A hall call is assigned to the upper car or the lower car according to the classification to which the hall in question belongs. In each of the priority zones, the upper car or the lower car is preferentially brought into service. In the common-use zone, after the existence or nonexistence of interference with a counterpart car is determined, the upper car or the lower car is caused to make an entry and is brought into service and, after a response, the upper car or the lower car is caused to escape from the common-use zone and is caused to retreat to an escape floor.

7 Claims, 10 Drawing Sheets

1
20F
(TF)
Upper-car
priority zone
UPZ
12F
11F
Common-use
zone CZ
2EU
2ED
2F
Main floor for the upper car
1F
Main floor for the lower car
B1F
Lower-car
priority zone
DPZ
B5F
(B1F)

1
20F
19F
18F
17F
16F
15F
14F
13F
12F
100 persons
900 persons in all
2F
Main floor for
the upper car 1
11F
10F
9F
8F
7F
6F
5F
4F
3F
100 persons
900 persons in all
1F
Main floor for
the lower car 1
20F (TF)
Upper-car priority zone UPZ
H3
H4
C1
C3
12F
11F
C2
C11
Common-use zone CZ
H2
H13
C12
H1
2F
5U
5D
1F
H12
H11
B1F
Lower-car priority zone DPZ
H14
H15
C13
B5F (BTF)
20F
5U
H23
H24
C21
C33
12F
11F
C32
H22
H33
C22
C23
2F
H21
H31
1F
C31
H32
B1F
C24
5D
H34
C34
H35
B5F
20F
H44
H43
12F
11F
H42
H41
2F
1F
B1F
5U
5D
B5F
20F
5U
5D
12F
11F
H53
2F
1F
B1F
H51
H52
H54
H55
B5F
: Upper car 5U, lower car 5D
: UP Hall call
: DOWN Hall call
: Car call 1
20F
Highest floor
C62
Upper-car priority zone UPZ
5U
P61
12F
11F
Entry-judgment floor
Retreat floor
C61
Common-use zone CZ
5D
H61
H62
Main floor for the upper car
2F
Main floor for the lower car
1F
B1F
Lower-car priority zone DPZ
B5F
Lowest floor
: Upper car 5U, lower car 5D
: Virtual hall call
: Car call
: UP hall call 1
20F
(TF)
Upper-car priority zone UPZ
H62
H63
C61
12F
11F
C71
H73
H74
Lower-car priority zone DPZ
Main floor for the upper car
2F
5U
5D
H61
H72
Main floor for the lower car
1F
B1F
H71
Lower-car priority zone DPZ
H75
C72
H76
B5F
(BTF)
H82
H83
C83
C81
C82
H93
H94
H81
H91
H92
C84
H95
H96
H102
H103
H101
H113
H114
H111
H112
H115
H116
: Upper car 5U, lower car 5D
: UP hall call
: DOWN hall call
: Car call

APPARATUS FOR ELEVATOR GROUP CONTROL

TECHNICAL FIELD

The present invention relates to an apparatus for group control of a set or a plurality of sets of elevators consisting of an upper car and a lower car which are disposed in a vertical relation within one elevator shaft and which ascend and descend independently, while avoiding mutual interference of the cars.

BACKGROUND ART

In conventional elevators, a shaft was usually provided for each elevator and one car was housed in one shaft. Therefore, in a case where a plurality of elevators are installed, shafts for the number of elevators were juxtaposed and hence each car could ascend and descend freely without interfering with other cars. In such an installed condition, a plurality of elevators were subjected to group control for an improvement in transportation efficiency.

Incidentally, in a high-rise building where a large number of elevators are installed, installing a shaft for each car posed the problem that the ratio of the area of the shaft portion to the floor area of the building is too high.

Therefore, to reduce the area of the shaft portion, in Japanese unexamined laid-open patent publication No. 2000-226164, for example, there is disclosed an apparatus for elevator group control in which a plurality of cars are brought into service within the same shaft, and when a hall call is registered, whether a retreat is necessary is judged by calculating the mutual interference of the cars. When a retreat is necessary, by causing cars other than assigned cars to retreat, the mutual interference of the cars is prevented thereby to respond to the hall call.

In the apparatus for elevator group management described in the above-described Japanese unexamined laid-open patent publication No. 2000-226164, however, although the ratio of the area of the shaft portion to the floor area of the building is reduced, the upper car and the lower car compete with each other in the assignment of a hall call because the upper car and the lower car use almost the entire zone of the shaft as a common service zone with the exception of terminal floors. For this reason, the unassigned cars must be in retreat in order not to impede the operation of the assigned cars, thus posing the problem that the transportation efficiency decreases.

Furthermore, in Japanese unexamined laid-open patent publication No. 6-305648, there is disclosed a multicar type elevator system in which the two top portions and two bottom portions of two shafts are each connected by a horizontal shaft to form annular shafts and a plurality of cars are housed in these annular shafts to permit circulation in a specific direction. In this elevator system, when a succeeding car enters into a prescribed distance from a preceding car in the travel direction, the succeeding car is stopped thereby to prevent a collision.

However, in a circulation type elevator, when the elevator is to go to a floor in a direction reverse to the circulation direction although a destination floor is near in terms of distance, the elevator must almost make one round in a circulation path. In particular, an elevator in which a plurality of cars are housed in one shaft is to be installed in a high-rise building and, therefore, taking a round in the above-described circulation path means that the elevator takes a round between the lowest floor of the building and the highest floor thereof. For this reason, the circulation type elevator poses the problem that much time is taken and the transportation efficiency is low. In order to solve this problem, it is also conceivable to juxtapose elevators which circulate in the reverse direction. However, this posed the new problem of excessive equipment.

The present invention was made to solve the above-described problems and has as its object the provision of an apparatus for elevator group control which avoids mutual interference of a set or multiple sets of elevators consisting of an upper car and a lower car which are disposed in a vertical relation within one elevator shaft and which ascend and descend independently, and which also improves transportation efficiency.

DISCLOSURE OF THE INVENTION

In an apparatus for elevator group control which performs group control of a set or a plurality of sets of elevators consisting of an upper car and a lower car which are disposed in a vertical relation within one elevator shaft communicating with each floor of a building and which ascend and descend independently, the floors are classified in such a manner that a floor communicating with an entrance of the building is classified as a main floor for the lower car, a floor communicating with an entrance of the building at a level higher than this main floor for the lower car is classified as a main floor for the upper car, a lower-floor portion of the shaft is classified as a lower-car priority zone, an upper-floor portion is classified as an upper-car priority zone and an intermediate-floor portion is classified as a common-use zone in which the upper car and the lower car are brought into service. When a hall call occurs, the hall call is assigned to the upper car or the lower car according to the above-described classification to which the hall in question belongs, and as a result of this assignment, in each of the priority zones the upper car or the lower car is preferentially brought into service. When the upper car or the lower car is brought into service in the common-use zone, the upper car or the lower car is caused to make an entry after the existence or nonexistence of interference with a counterpart car is judged and after a response the upper car or the lower car is caused to escape from the common-use zone and is caused to be in retreat on the retreat floor.

For this reason, the upper-car priority zone and the lower-car priority zone are completely separated on both top and bottom sides of the shaft through the common-use zone and, therefore, the upper car and the lower car do not interfere with each other when they are in service in their respective priority zones. As a result, the two cars can ascend and descend freely and high transportation efficiency is exhibited.

Also, when the upper car or the lower car is brought into service in the common-use zone, it is ensured that the upper car or the lower car makes an entry only after a judgment is made on entyr propriety. Therefore, the mutual interference of the upper car and the lower car can be avoided.

Furthermore, because it is ensured that after a response to a call in the common-use zone, a car is caused to escape from the common-use zone and is brought into retreat on a retreat floor, the possibility of the mutual interference of the upper car and the lower car is limited. Furthermore, it is possible to keep the transportation efficiency from decreasing due to the action for the avoidance of interference.

Also, in the present invention, the upper-car priority zone and the common-use zone are classified so as to obtain the best approximation in the number of occupants in these zones in a building, who are the objects of transportation.

As a result of this, it is possible to equalize peak loads applied to the upper car and the lower car especially in the time zone of the beginning of office hours.

Furthermore, in the present invention, the traffic volume in the upper-car priority zone and the traffic volume in the common-use zone are measured and the upper-car priority zone and the common-use zone are classified to obtain the best approximation in the measured values of the traffic volumes.

As a result of this, it is possible to equalize loads applied to the upper car and the lower car on the basis of actual traffic volumes.

Moreover, in the present invention, the main floor for the lower car is set as a retreat floor for the lower car, the lowest floor of the upper-car priority zone is set as a retreat floor for the upper car, and a virtual hall call is caused to occur with these retreat floors regarded as halls, whereby retreat instructions are given by assigning this virtual hall call to the upper car or the lower car.

Accordingly, the possibility of mutual interference can be reduced, and at the same time, the ascent and descent distance for a retreat can be made short because both of the retreat floors are closest to the common-use zone.

Moreover, in the present invention, in a case where a hall call registered on a floor which is nearer to the terminal floor than to the retreat floor is assigned to the upper car or the lower car to which a virtual hall call has been assigned or in a case where a car call is registered with the above-described floor on the terminal floor side serving as a service floor, the above-described virtual hall call which has been assigned is cancelled.

For this reason, a retreat operation which performs only a retreat is stopped, and a car goes straight to a floor of call. Therefore, it is possible to improve transportation efficiency.

Moreover, in the present invention, the lowest floor is newly set as a retreat floor for the lower car when a car call with the lower-car priority zone serving as a service floor has been registered for the upper car and the highest floor is newly set as a retreat floor for the upper car when a car call with the upper-car priority zone serving as a service floor has been registered for the lower car, whereby retreat instructions are given by causing a virtual hall call to occur on each floor.

For this reason, by causing one car to be brought into retreat to the terminal floor, the other car can use, without interference, all floors to which the car can ascend and descend as the object of service and it is possible to reduce the possibility of forcing passengers in the car to change car.

Moreover, in the present invention, floors are classified in such a manner that an entrance floor for the lower car is classified as a main floor for the lower car, an entrance floor for the upper car is classified as a main floor for the upper car, an upper half of a zone obtained by dividing a portion from a floor immediately above the main floor for the upper car to the highest floor into two is classified as an upper-car priority zone, and a lower half and a portion from a floor immediately below the main floor for the lower car to the lowest floor are classified as a lower-car priority zone. When a hall call occurs, the hall call is assigned to the upper car or the lower car according to the above-described classification to which the hall in question belongs, and as a result of this assignment, in each of the priority zones, the upper car or the lower car is preferentially brought into service. When a car enters the priority zone of a counterpart car, the car is caused to make an entry after the existence or nonexistence of interference is judged, and after a response the car is caused to escape from the priority zone of the counterpart car and is caused to be in retreat in the retreat floor.

Also in this invention, both cars can ascend and descend freely in their own priority zones, therefore, it is possible to cause the cars display high transportation efficiency. Furthermore, when a car enters the priority zone of a counterpart car, the upper car or the lower is caused to make an entry after a judgment is formed on entry propriety. Therefore, it is possible to avoid the mutual interference of the upper car and the lower car. Furthermore, because the cars are caused to be in retreat on retreat floors after use, the possibility of the mutual interference of the upper car and the lower car is limited. In particular, as the lower-car priority zone is provided in place of the common-use zone, this apparatus is suitable for buildings in which mutual traffic between the lower-car priority zone and the upper-car priority zone is little.

BEST MODE FOR CARRYING OUT THE INVENTION

To describe the present invention in more detail, the invention will be described below by referring to the accompanying drawings.

First Embodiment

FIG. 1 to FIG. 8 show the first embodiment of a preferred apparatus for elevator group control related to the present invention.

Figure 1:
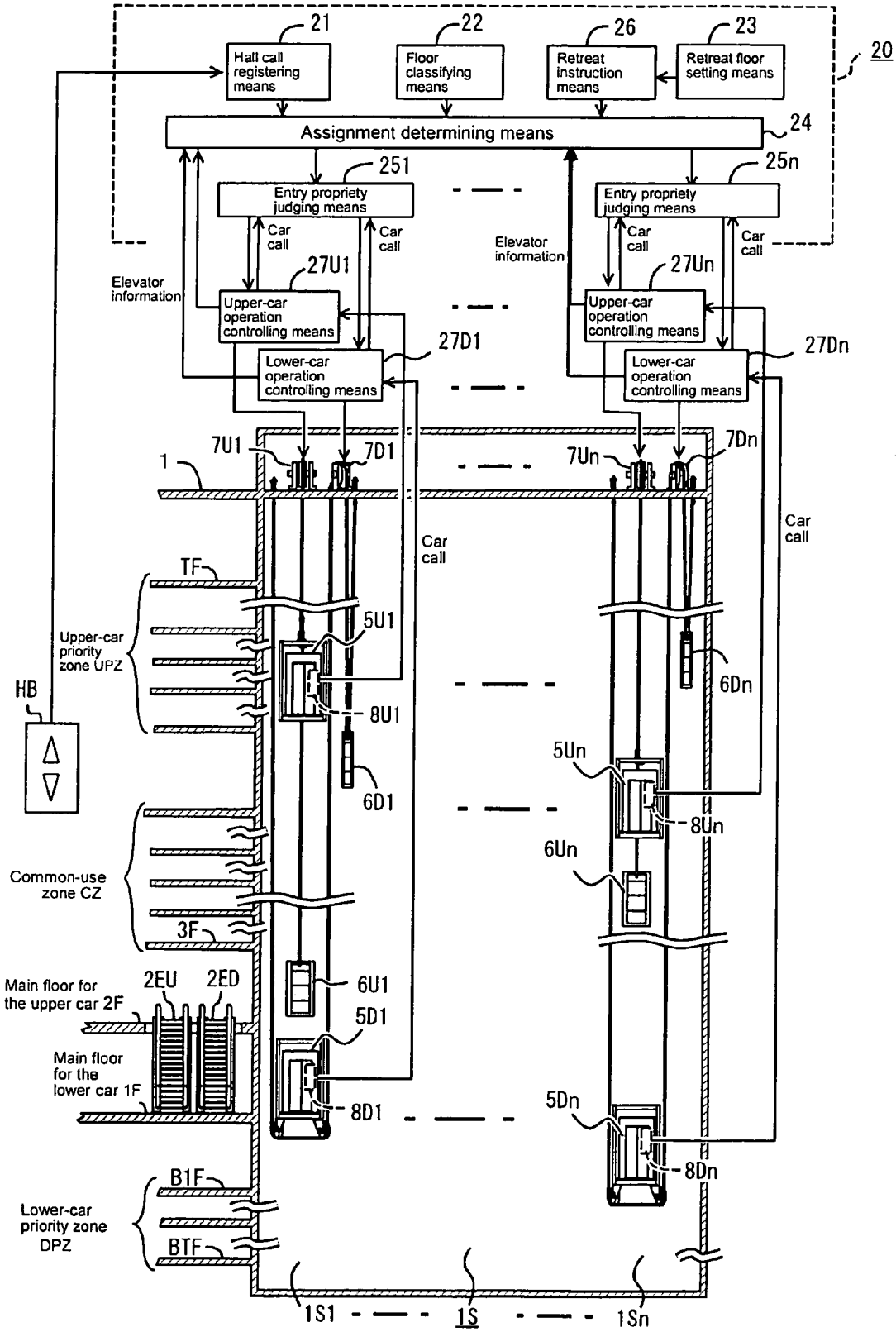
FIG. 1 is a block diagram showing the preferred configuration of an apparatus for elevator group control related to the first embodiment of the present invention.

FIG. 1 is a block diagram showing the configuration of an apparatus for elevator group control. Reference numeral 1 denotes a building in which n sets of elevators, each set consisting of an upper car and a lower car, and reference numeral 1S denotes a shaft in which n sets of elevators are housed and this shaft is constituted by a shaft 1S1 for the first set to a shaft 1*n*1 for the n-th set.

Reference numeral 5U1 denotes an upper car disposed within the shaft 1S1 for the first set, reference numeral 5D1 denotes a lower car disposed immediately below the upper car 5U1, reference numeral 6U1 denotes a balancing weight of the upper car 5U1, and reference numeral 6D1 denotes a balancing weight of the lower car 5D1. Reference numeral 7U1 denotes a hoisting machine which causes the upper car 5U1 to ascend and descend and reference numeral 7D1 denotes a hoisting machine which causes the lower car 5D1 to ascend and descend, both being able to cause the upper car 5U1 and the lower car 5D1 to ascend and descend independently. Reference numeral 8U1 denotes a car control panel of the upper car 5U1 and reference numeral 8D1 denotes a car control panel of the lower car 5D1.

Reference numeral 5Un denotes an upper car disposed within the shaft 1Sn for the n-th set, reference numeral 5Dn denotes a lower car disposed immediately below the upper car 5Un, reference numeral 6Un denotes a balancing weight of the upper car 5Un, and reference numeral 6Dn denotes a balancing weight of the lower car 5Dn. Reference numeral 7Un denotes a hoisting machine which causes the upper car 5Un to ascend and descend and reference numeral 7Dn denotes a hoisting machine which causes the lower car 5Dn to ascend and descend, both being able to cause the upper car 5Un and the lower car 5Dn to ascend and descend independently. Reference numeral 8Un denotes a car control panel of the upper car 5Un and reference numeral 8Dn denotes a car control panel of the lower car 5Dn.

The second set to the (n−1)th set which are omitted are similarly configured.

Incidentally, the upper car 5U is named when the upper cars 5U1 to 5Un are generically named, the lower car 5D is named when the lower cars 5D1 to 5Dn are generically named, the hoisting machines 7U and 7D are named when the hoisting machines 7U1 to 7Un and 7D1 to 7Dn are generically named, and the car control panels 8U and 8D are named when the car control panels 8U1 to 8Un and 8D1 to 8Dn are generically named.

Reference numeral 1F denotes a main floor for the lower car, which is composed of the first floor where the lower car 5U causes passengers who come in and out of the building 1 to ascend and descend, and reference numeral 2F denotes a main floor for the upper car, which is located immediately above the main floor for the lower car 1F composed of the second floor where the upper car 5U causes passengers who come in and out of the building 1 to ascend and descend. Reference numeral 3F denotes the third floor, the character TF denotes the highest floor, the character B1F denotes the first basement, and the character BTF denotes the lowest floor.

The character DPZ denotes a lower-car priority zone consisting of floors from the floor B1F immediately below the main floor for the lower car 1F to the lowest floor BTF, the character UPZ denotes an upper-car priority zone consisting of floors of an upper half obtained by dividing a portion from the floor 3F immediately above the main floor for the upper car 2F to the highest floor TF into two, and the character CZ denotes a common-use zone consisting of floors of a lower half.

Reference numeral 2EU denotes an escalator which ascends from the main floor for the lower car 1F to the main floor for the upper car 2F and reference numeral 2ED denotes an escalator which descends from the main floor for the upper car 2F to the main floor for the lower car 1F. The character HB representatively denotes a hall button which is provided on each floor to cause a hall call to occur.

Reference numeral 20 denotes a controller for group control which performs the group control of a plurality of sets of elevators, a set of which consisting of the upper car 5U and the lower car 5D. The apparatus for group control comprises hall call registering means 21, which registers a hall call from the hall button HB, floor classifying means 22, which classifies the floors into the main floor for the upper car 2F, the main floor for the lower car 1F, the lower-car priority zone DPZ, the upper-car priority zone UPZ and the common-use zone CZ, retreat floor setting means 23, which sets floors not impeding the operation of a counterpart car as retreat floors, assignment determining means 24, which assigns a hall call registered on the main floor for the lower car 1F and in the lower-car priority zone DPZ to the lower car 5D, assigns a hall call registered on the main floor for the upper car 2F and in the upper-car priority zone UPZ to the upper car 5U and allocates a hall call registered in the common-use zone CZ to either the upper car 5U or the lower car 5D according to an operating condition, entry propriety judging means 251 to 25*n* (hereinafter generically named 25), which judges entry propriety for each of the upper car 5U and the lower car 5D according to the existence or nonexistence of the possibility of interference with the counterpart car when the upper car 5U enters the common-use zone CZ or the lower-car priority zone DPZ or when the lower car 5D enters the common-use zone CZ or the upper-car priority zone UPZ, and retreat instruction means 26, which gives instructions to the upper car 5U or the lower car 5D which has made its entry to be in retreat on the retreat floor according to the judgement result of the entry property judging means 25. Incidentally, concretely speaking, retreat instructions are given by causing a virtual hall call to occur on the retreat floor and assigning this virtual hall call to the upper car 5U or the lower car 5D. Reference numerals 27U1 to 27Un denote upper-car operation controlling means, which operate the upper cars SU1 to SUn on the basis of judgment results of the entry propriety judging means 251 to 25*n* in order to evoke a response to a hall call which has been assigned by the assignment determining means 24 and a car call which has been registered by the car control panels 8U1 to 8Un of their own cars, and are hereinafter named 27U in the case of generic designation. Also reference numerals 27D1 to 27Dn denote lower-car operation controlling means, which are similarly configured and which operate the lower cars 5D1 to 5Dn in order to evoke a response to a hall call and a car call which has been registered by the car control panels 8D1 to 8Dn of their own cars, and are hereinafter named 27D in the case of generic designation.

Figure 2:
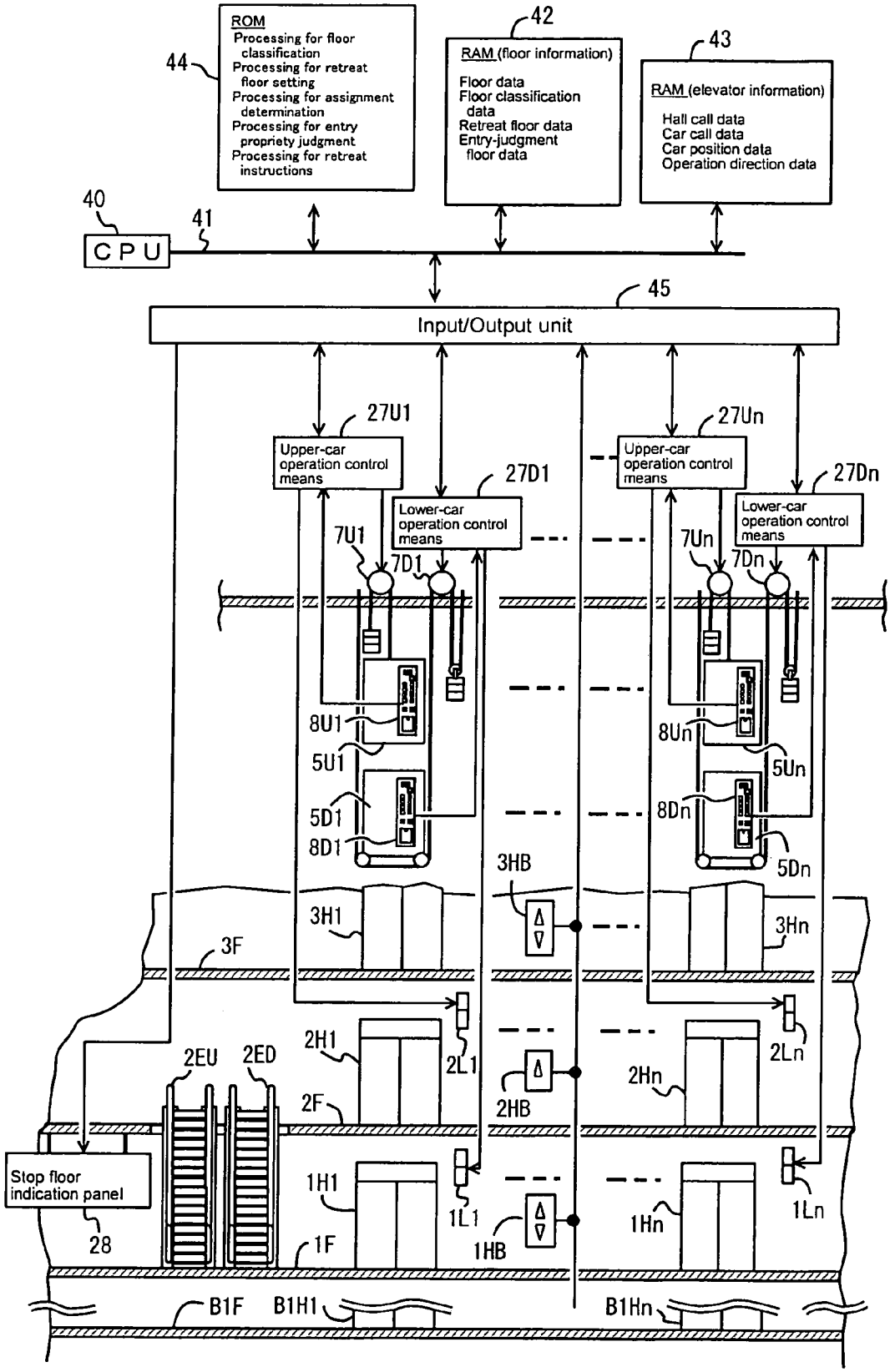
FIG. 2 is a block diagram showing a control circuit of an apparatus for elevator group control related to the first embodiment of the present invention.

FIG. 2 is a block diagram showing a control circuit of an apparatus for elevator group control and like numerals as in FIG. 1 refer to like parts. In the figure, reference numerals B1H1, 1H1, 2H1 and 3H1 denote the hall doorways, respectively, on the first basement, the first floor, the second floor and the third floor of the first set of elevators, and reference numerals B1Hn, 1Hn, 2Hn and 3Hn denote the hall doorways, respectively, on the first basement, the first floor, the second floor and the third floor of the n-th set of elevators.

Reference numerals 1HB, 2HB and 3HB denote the hall buttons, respectively, on the first floor, the second floor and the third floor commonly provided for each elevator.

Reference numerals 1L1 and 2L1 denote hall lanterns provided in the halls on the first floor and second floor for the first set of elevators, and reference numerals 1Ln and 2Ln denote hall lanterns provided in the halls on the first floor and second floor for the n-th set of elevators. Reference numeral 28 denotes a stop floor indication panel on which stop floors from the main floor for the upper car 2F and from the main floor for the lower car 1F.

Figure 3:
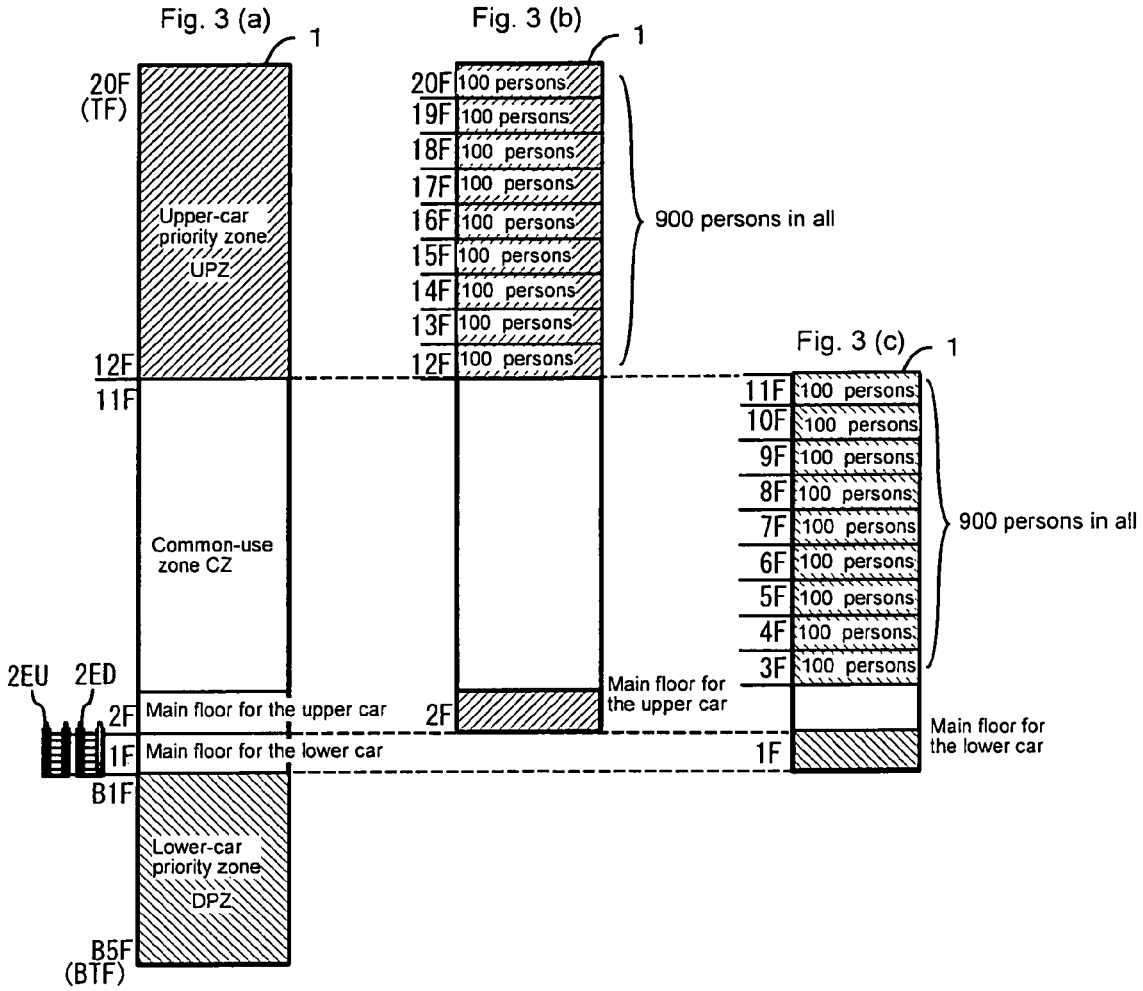
FIGS. 3(*a*) to (*c*) are explanatory diagrams showing the concept of classifying floors related to the first embodiment of the present invention.
Figure 5:
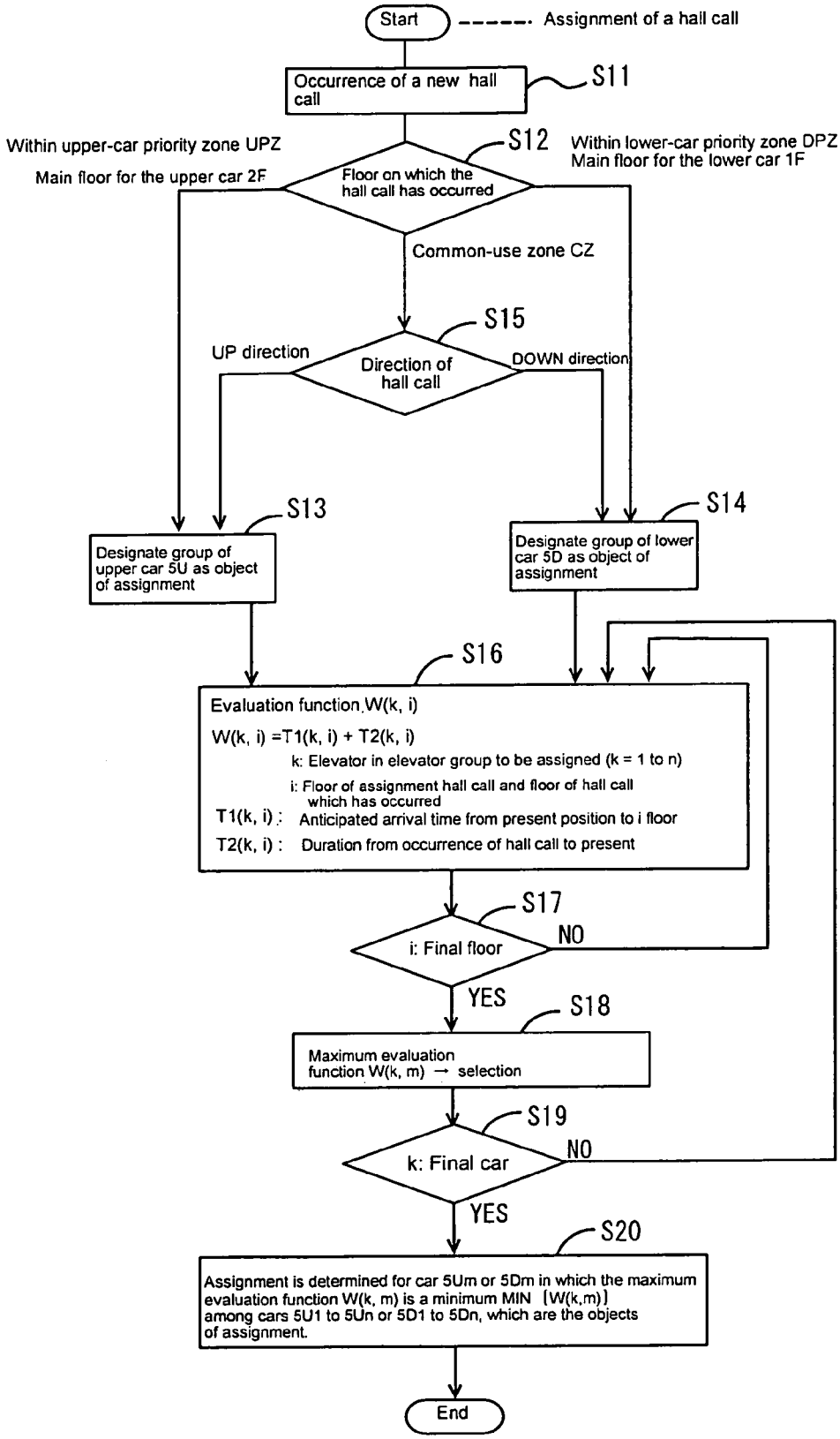
FIG. 5 is a flow chart showing the procedure for the operation of hall calls related to the first embodiment of the present invention.
Figure 6:
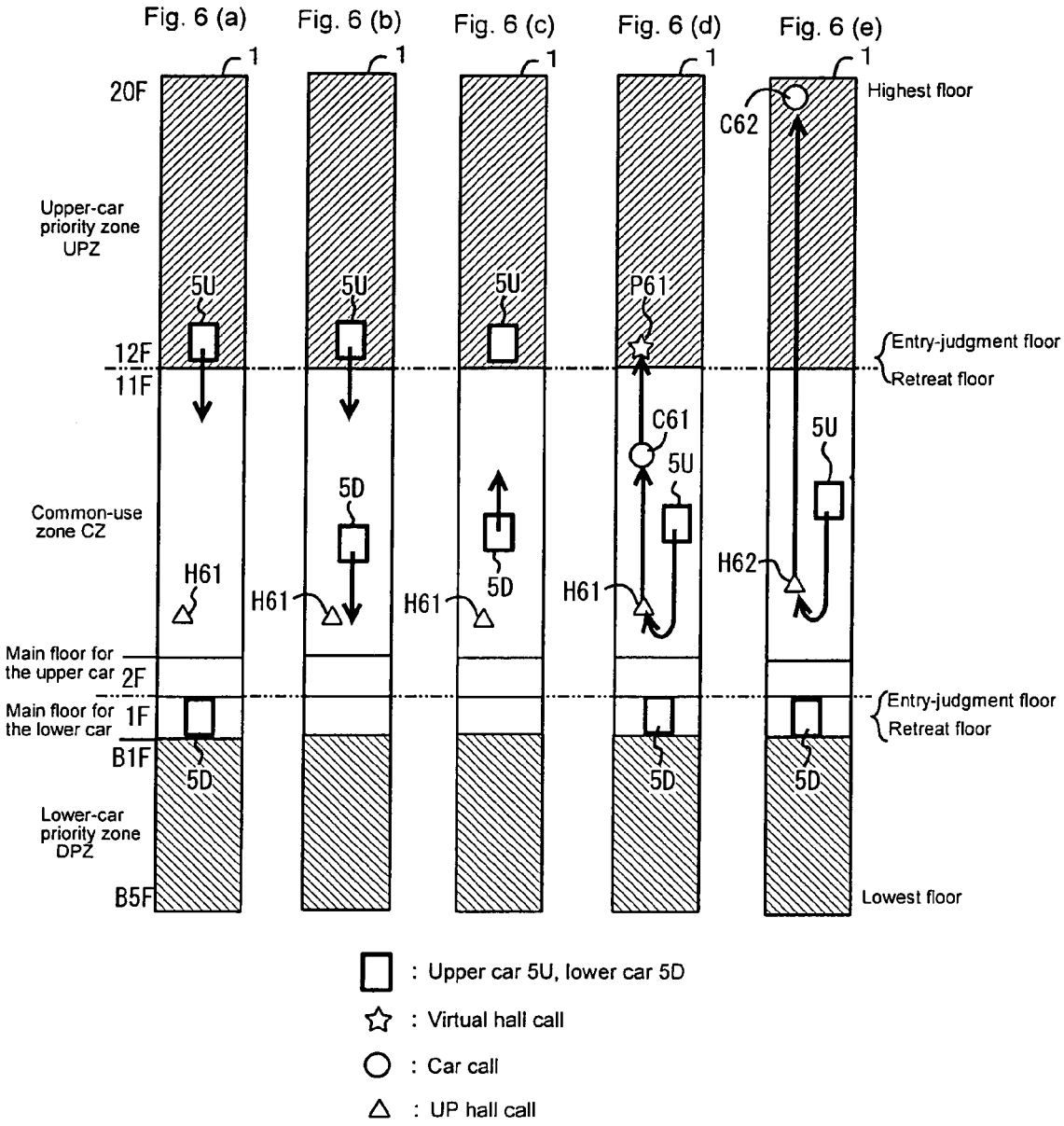
FIGS. 6(*a*) to 6(*e*) are explanatory diagrams showing the concept of a judgment on the propriety of an entry to the common-use zone and of retreat operation related to the first embodiment of the present invention.

Reference numeral 40 denotes a CPU, reference numeral 41 denotes a bus connected to this CPU, reference numeral 42 denotes a RAM in which information on floors is recorded. This information is floor data comprising the number of floors, the floor-to-floor height, the number of occupants on each floor, etc., the floor classification data shown in FIGS. 3(*a*) to 3(*c*) and the retreat floor data and access-judgment floor data shown in FIGS. 6(*a*) to 6(*e*). Reference numeral 43 denotes an RAM in which information on elevators is recorded. This information is hall call data, car call data, car position data and operation direction data. Reference numeral 44 denotes a ROM in which various programs are recorded. The programs comprise the processing for floor classification to classify floors as shown in FIGS. 3(*a*) to 3(*c*) on the basis of the floor data of the RAM 42 and to store the results as floor classification data in the RAM 43, the processing for retreat floor setting to set floors not impeding the operation of a counterpart car as retreat floors, the processing for assignment determination to assign a hall call to the upper car 5U or the lower car 5D as shown in FIG. 5, the processing for entry propriety judgment to judge the propriety of an entry to the common-use zone CZ or the priority zone UPZ or DPZ of a counterpart car as shown in FIGS. 6(*a*) to (*e*) and FIG. 7, and the processing for retreat instructions to give instructions to be in retreat on a retreat floor registered in the RAM 42. Reference numeral 45 denotes an input/output unit which is connected to the bus 41 and performs the giving and receiving of signals to and from external devices.

FIGS. 3(*a*) to 3(*c*) are each explanatory diagrams showing the concept of classifying floors and show a case where the first floor is an entrance floor and the floors from the fifth basement to the 20th floor above ground are serviced by elevators.

First, the entrance floor of the building is used as the main floor for the lower car 1F and a floor immediately above this main floor for the lower car 1F is used as the main floor for the upper car 2F. The escalators 2EU, 2ED are installed in order to ensure the convenience of traffic between the main floor for the upper car 2F and the entrance floor.

The floors from the first basement B1F to the fifth basement B5F are added to the lower-car priority zone DPZ because the number of occupants is usually small.

The floors from the third floor to the 20th floor are shared by the upper car 5U and the lower car 5D. In this case, it is desirable that the transportation efficiency of the two cars 5U and 5D be balanced. As a technique for balancing, classification is performed so that the best approximation is obtained in the total value of the number of occupants on each floor. In FIGS. 3(*a*) to 3(*c*), if the number of occupants on each of the floors is 100 persons, then the total number of persons on the third floor to the 11th floor is 900 persons and the total number of persons on the 12th floor to the 20th floor is also 900, with the result that an approximation is obtained. Therefore, the floors from the third floor to the 11th floor are used as the common-use zone CZ and the floors from the 12th floor to the 20th floor are used as the upper-car priority zone UPZ. As a result of this, it is possible to equalize peak traffic volumes in the time zone of the beginning of office hours between the upper car 5U and the lower car 5D. Furthermore, by increasing the speed of the upper car 5U, it is also possible to equalize the transportation capacity through a compensation of a difference in distance.

Figure 4:
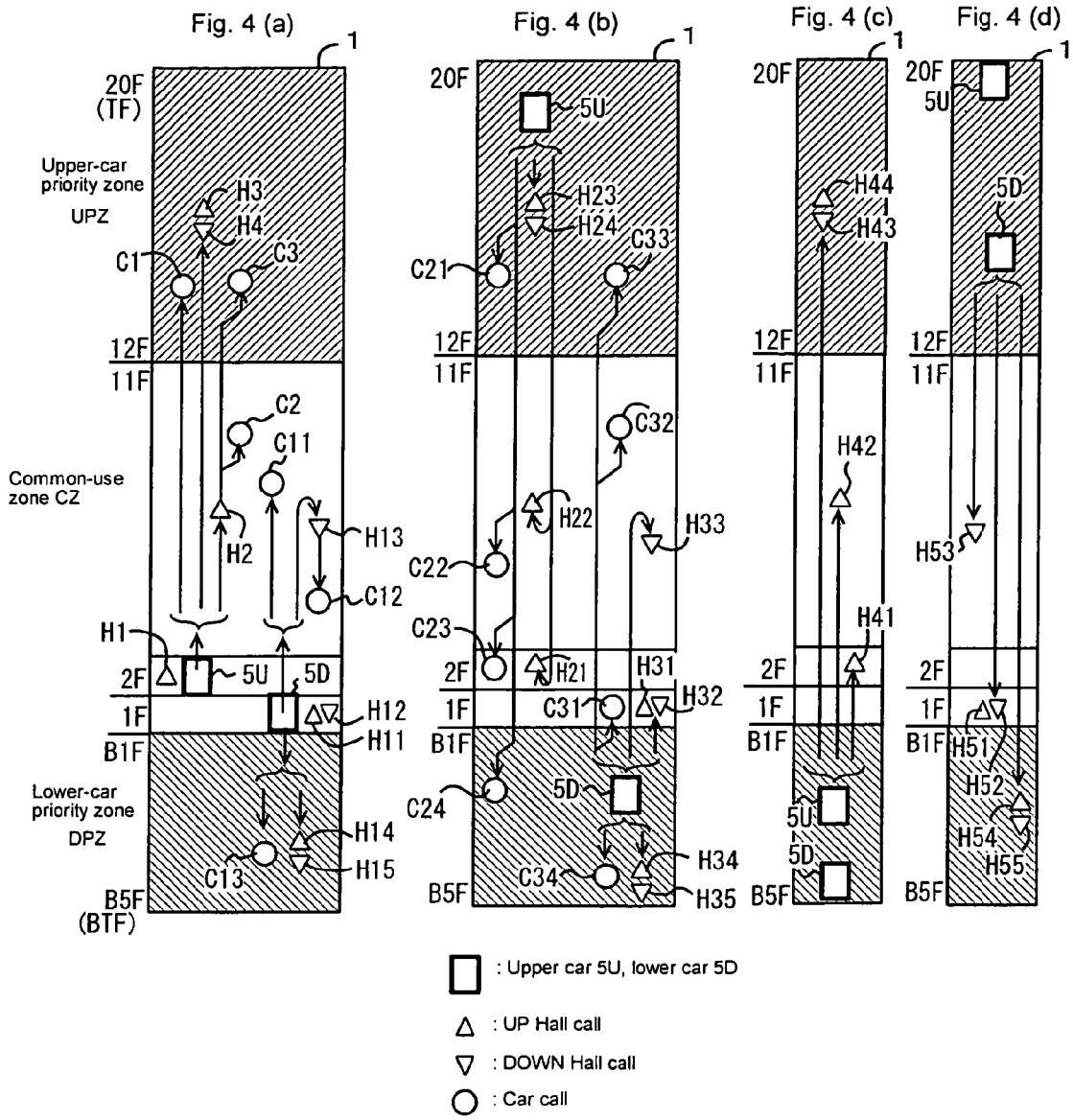
FIGS. 4(*a*) to 4(*d*) are each explanatory diagrams showing the operation of the upper car and the lower car related to the first embodiment of the present invention.

Next, FIGS. 4(*a*) to 4(*d*) are each explanatory diagrams showing the operation of the upper car and the lower car. An outline of the operation of the upper car 5U and the lower car 5D will be given below.

In the upper-car priority zone UPZ the upper car 5U can respond to both a hall call and a car call. Also, in the lower-car priority zone DPZ the lower car 5U can respond to both a hall call and a car call. In the common-use zone CZ, the upper car 5U can respond to an UP hall call, the lower car 5D to a DOWN hall call, respectively. The details will be described below.

1. FIG. 4(*a*)

(1) When 5U, the Upper Car, is at a Stop on the Main Floor 2F, for the Upper Car On 2F, the main floor for the upper car, the upper car 5U can respond to an UP hall call H1. The reason for the limitation to the UP hall call H1 is that the upper-car priority zone UPZ does not exist below. In the upper-car priority zone UPZ, the upper car 5U can respond to an UP hall call H3 and a DOWN hall call H4, and in the common-use zone CZ the upper car 5U can respond to an UP hall call H2.

Furthermore, the fact that the upper car 5U has moved to the common-use zone CZ in response to a car call C1 in the upper-car priority zone and the UP hall call H2 enables a car call C2 in the common-use zone CZ and a car call C3 in the upper-car priority zone UPZ to be registered.

(2) When 5D, the Lower Car, is at a Stop on 1F, the Main Floor for the Lower Car On the main floor for the lower car 1F the lower car 5D can respond to an UP hall call H11 and a DOWN hall call H12. In the lower-car priority zone DPZ, the lower car 5D can respond to an UP hall call H14 and a DOWN hall call H15, and in the common-use zone, the lower car 5D can respond to a DOWN hall call H13.

Furthermore, it is possible to register a car call C11 in the common-use zone CZ, and a car call C13 in the lower-car priority zone DPZ. It is also possible to register a car call 12 when the lower car 5D which has responded to the DOWN hall call H13 is in the common-use zone CZ.

Incidentally, service floors from the main floor for the lower car 1F, i.e., the lower-car priority zone DPZ and the common-use zone CZ as well as service floors from the main floor for the upper car 2F, i.e., the upper-car priority zone UPZ are displayed on the stop floor guidance panel 28.

2. FIG. 4(*b*)

(1) When the Upper Car 5U is in the Upper-car Priority Zone UPZ

The upper car 5U can respond to an UP hall call 21 on the main floor for the upper car 2F, an UP hall call H22 in the common-use zone CZ, and an UP hall call H23 and a DOWN hall call H24 in the upper-car priority zone UPZ.

Furthermore, it is possible to register a car call C21 in the upper-car priority zone UPZ, a car call C22 in the common-use zone CZ, a car call C23 on the main floor for the upper car 2F and a car call C24 in the lower-car priority zone DPZ. The purpose is to transport passengers in the upper-car priority zone UPZ to each floor.

(2) When the Lower Car 5D is in the Lower-car Priority Zone DPZ

The lower car 5D can respond to an UP hall call H31 and a DOWN hall call H32 on the main floor for the lower car 1F, a DOWN hall call H33 in the common-use zone CZ, and an UP hall call H34 and a DOWN hall call H35 in the lower-car priority zone DPZ.

Furthermore, it is possible to resister a car call C33 in the upper-car priority zone UPZ, a car call C32 in the common-use zone CZ, a car call C31 on the main floor for the lower car 1F, and a car call C34 in the lower-car priority zone DPZ. The purpose is to transport passengers in the lower-car priority zone DPZ to each floor.

3. FIG. 4(*c*)

(1) When the Upper Car 5U is in the Lower-Car Priority Zone DPZ

The upper car 5U can respond to an UP hall H41 on the main floor for the upper car 2F, an UP hall call H42 in the common-use zone CZ, and an UP hall call H43 and a DOWN hall call H44 in the upper-car priority zone UPZ.

It is impossible to register car calls. This is because the upper car 5U rapidly escapes from the lower-car priority zone DPZ thereby to release the lower car 5D from its retreat state.

(2) Operation of the Lower Car 5D

When the upper car 5U is in the lower-car priority zone DPZ, the lower car 5D comes to a retreat state on the lowest floor B5F in order to avoid interference. Therefore, when the upper car 5U escapes from the lower-car priority zone DPZ, the lower car 5D comes to the above-described state of FIG. 4(*b*) and responds to a call.

4. FIG. 4(*d*)

(1) When the Lower Car 5D is in the Upper-car Priority Zone UPZ

The lower car 5D can respond to an UP hall call H51 and a DOWN hall call H52 on the main floor for the lower car 1F, a DOWN hall call H53 in the common-use zone CZ, and an UP hall call H54 and a DOWN hall call H55 in the lower-car priority zone DPZ.

It is impossible to register car calls. This is because the lower car 5D rapidly escapes from the upper-car priority zone UPZ, thereby to release the upper car 5U from its retreat state.

(2) Operation of the Upper Car 5U

When the lower car 5D is in the upper-car priority zone UPZ, the upper car 5U comes to a retreat state on the highest floor 20F in order to avoid interference. Therefore, when the lower car 5D escapes from the upper-car priority zone UPZ, the upper car 5U comes to the above-described state of FIG. 4(*b*) and responds to a call.

Next, FIG. 5 is a flow chart showing the procedure for the application operation of hall calls. The assignment operation of hall calls will be described below on the basis of the figure.

At Step S11, it is assumed that a new car call has occurred. At Step S12, an examination is made into a floor on which this hall call has occurred.

Processing at Step S12

(1) In a case where the hall call has occurred in the upper-car priority zone UPZ or on the main floor for the upper car 2F, the processing proceeds to Step S13 and the group of the upper car 5U is designated as the object of assignment. The hall calls H1, H3 and H4 of FIG. 4(*a*), the hall calls H21, H23 and H24 of FIG. 4(*b*) and the hall calls H41, H43 and H44 of FIG. 4(*c*) fall under this case.

(2) In a case where the hall call has occurred in the lower-car priority zone DPZ or on the main floor for the lower car 1F, the processing proceeds to Step S14 and the group of the lower car 5D is designated as the object of assignment. The hall calls H11, H12, H14 and H15 of FIG. 4(*a*), the hall calls H31, H32, H34 and H35 of FIG. 4(*b*) and the hall calls H51, H52, H54 and H55 of FIG. 4(*d*) fall under this case.

(3) In a case where the hall call has occurred in the common-use zone CZ, the processing proceeds to Step S15 and the direction of the hall call is examined.

Processing at Step S15

(1) In the case of an UP hall call, the processing proceeds to Step S13 and the group of the upper car 5U is designated as the object of assignment. The hall calls H12, H22 and H42 of FIGS. 4(*a*) to 4(*d*) fall under this case. This is because an UP hall call is for the transportation of passengers to the direction of the upper-car priority zone UPZ.

(2) In the case of a DOWN hall call, the processing proceeds to Step S14 and the group of the lower car 5D is designated as the object of assignment. The hall calls H13, H23 and H53 of FIGS. 4(*a*) to 4(*d*) fall under this case. This is because a DOWN hall call is for the transportation of passengers to the direction of the lower-car priority zone DPZ.

When an elevator group as an object of assignment has been designated, a car is selected from this elevator group and the hall call which has newly occurred is assigned in accordance with the processing at Step S16 to Step S20. A hitherto widely adopted method in elevator group management control systems is adopted for the assignment of a hall call, and the assignment method described in Japanese unexamined laid-open patent publication No. 54-102745 is adopted in the present invention.

More specifically, at Step S16, it is assumed that the new hall call has been assigned to the No. k car, and the time which passes while this No. k car arrives from the present position to the floor of the assigned hall call and the floor of the new hall call is calculated in terms of probability as the anticipated arrival time T1 (k, i) by anticipating the number of persons who get on and off on each floor. The evaluation function W (k, i) is calculated by adding the duration T2 (k, i) which passes from the occurrence of the hall call to present to this anticipated arrival time T1 (k, i). When the evaluation function W (k, i) is calculated up to the final floor of the assigned hall call, the processing proceeds from Step S17 to Step S18 and a maximum evaluation function W (k, m) is selected from the evaluation functions W (k, i) of each hall call of the No. n car. When a maximum evaluation function W (k, m) has been selected for cars of all numbers from the No. 1 car to the No. k car, the processing proceeds from Step S19 to Step S20 and a new hall call is assigned to the car 5Um or 5Dm having a minimum evaluation function MIN {W (k, m)} among the maximum evaluation functions W (k, m) selected for the car groups 5U1 to 5Un or 5D1 to 5Dn which are the objects of assignment.

Next, FIGS. 6(*a*) to 6(*e*) are explanatory diagrams showing the concept of a judgment on the propriety of an entry to the common-use zone and of retreat operation. First, a judgment on the propriety of an assignment of the upper car 5U will be described by referring to FIGS. 6(*a*) to 6(*c*).

The assignment-judgment floor of the upper car 5U is the end floor of the upper-car priority zone UPZ on the side of the common-use zone CZ, i.e., the retreat floor 12F. Similarly, the assignment-judgment floor of the lower car 5D is the end floor of the common-use zone CZ, i.e., the retreat floor 1F, which is also the main floor for the lower car.

FIG. 6(*a*) shows a case where an UP hall call H61 has occurred in the common-use zone CZ and been assigned to the upper car 5U and this upper car 5U enters the common-use zone CZ in order to make a response.

Because the lower car 5D is in retreat on the retreat floor 1F, it is judged that no interference occurs even when the upper car 5U enters the common-use zone CZ. On the basis of this judgment result, the upper car 5U enters the common-use zone CZ and can respond to the UP hall call H61.

FIG. 6(*b*) also shows a similar case. However, the lower car 5D is in the common-use zone CZ and in a descending operation. Also in this case, the lower car 5D is in a direction in which the lower car 5D is moving away from the upper car 5U and it is judged that no interference occurs. The upper car 5U can enter the common-use zone CZ and respond to the UP hall call H61.

In the case of FIG. 6(*c*), the lower car 5D is in the common-use zone CZ and in an ascending operation. For this reason, if the upper car 5U is caused to enter the common-use zone CZ, there is a high possibility of interference. Therefore, when the lower car 5D descends as shown in FIG. 6(*b*) with the upper car 5U continuing a retreat on the retreat floor 12F, the lower car 5D enters the common-use zone CZ and responds to the UP hall call H61.

FIG. 6(*a*) to FIG. 6(*c*) above show cases where a judgment is formed when the upper car 5U enters the common-use zone CZ. However, the same applies to a case where the lower car 5D enters the common-use zone CZ and also to a case where the upper car 5U or the lower car 5D enters the common-use zone CZ to respond to a car call. Therefore, the description of these cases is omitted.

Next, retreat operation will be described.

FIGS. 6(*d*) and 6(*e*) show the retreat operation of the upper car 5U.

FIG. 6(*d*) shows a case where the upper car 5U has responded to an UP hall call H61 in the common-use zone CZ, and a passenger who has got on by this UP hall call H61 registers a car call C61 with a destination floor within the common-use zone CZ. When the car call C61 is the final call of the upper car 5U, a virtual hall call 61 on the retreat floor 12F occurs and is assigned to the upper car 5U. This assignment enables the upper car 5U to be in retreat on the retreat floor 12F. This retreat enables the lower car 5D to enter the common-use zone CZ.

FIG. 6(*e*) shows a case where the upper car 5U has responded to an UP hall call H61 in the common-use zone CZ and a passenger who has got on by this UP hall call H61 registers a car call C62 with the highest floor 20F as the destination floor. In this case, the upper car 5U escapes from the common-use zone CZ and returns to the upper-car priority zone UPZ even when no virtual hall call is registered on the retreat floor 12F and, therefore, the above-described virtual hall call is cancelled. This cancellation can prevent the upper car 5U from making a useless stop on the retreat floor 12F.

Next, a judgment on an entry to the common-use zone and retreat operation will be described.

Figure 7:
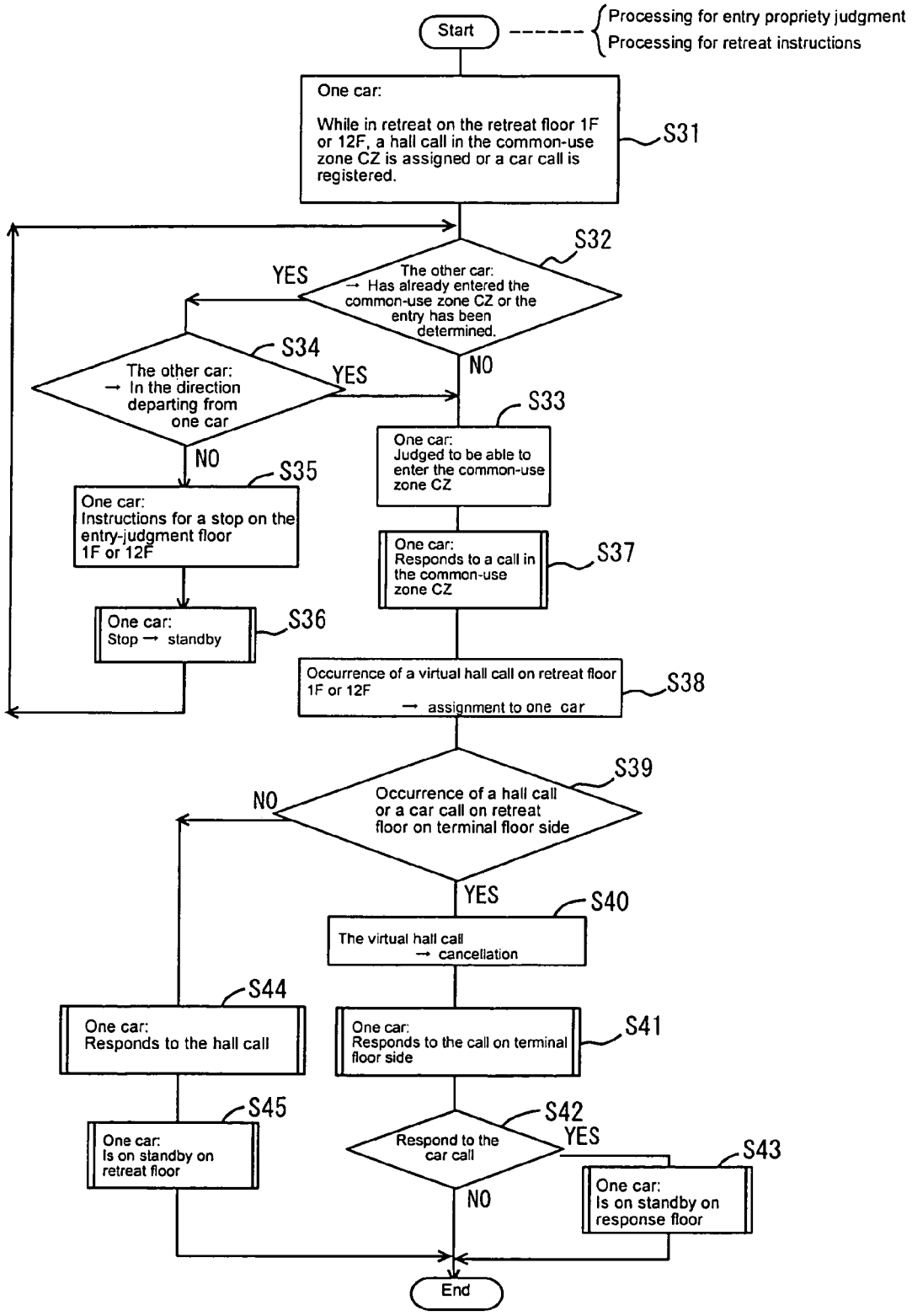
FIG. 7 is a flow chart showing the procedure for judgment on the propriety of an entry to the common-use zone and retreat operation related to the first embodiment of the present invention.

FIG. 7 is a flow chart showing the procedure for judgment on the propriety of an entry to the common-use zone and retreat operation. At Step S31, it is assumed that one car is assigned to a hall call which has occurred in the common-use zone CZ while in retreat on the retreat floor 1F or 12F or a car call with a service floor in the common-use zone CZ has been registered. At Step S32, in a case where the other car has not yet entered the common-use zone CZ and its entry has not yet been determined, either, the processing proceeds to Step S33 and it is judged that the other car can enter the common-use zone CZ. FIG. 6(*a*) falls under this case. At Step S32, in a case where the other car has already entered the common-use zone CZ or its entry has been determined, the proceeding proceeds to Step S34. In a case where the other car is operated in a direction in which the other car moves away from one car, the processing proceeds to Step S33 and it is judged that one car can make an entry. FIG. 6(*b*) falls under this case. In a case where at Step S34 the other car is not in a direction in which the other car moves away from one car, the other car is given instructions to make a stop on the entry-judgment floor 1F or 12F at Step S35 and to be on standby until it becomes able to make an entry at Step S36. FIG. 6(*c*) falls under this case. The processing returns to Step S32 and the processing is repeated.

When eventually it is judged at Step S33 that one car can enter the common-use zone CZ, at Step S37 one car enters the common-use zone CZ and responds to a hall call or a car call. When the response is finished, at Step S38 a virtual hall call is caused to occur on the retreat floor 1F or 12F and this virtual hall call is assigned to one car which has entered the common-use zone CZ.

At Step S39, in a case where apart from the virtual hall call, an assignment has been performed to a hall call on the terminal floor side from the retreat floor 1F or 12F, i.e., on the counter side from the common-use zone CZ, or a car call with a floor on the terminal floor side as a preceding floor has occurred, the processing proceeds to Step S40 and the virtual hall call is cancelled. This cancellation enables a useless stop on the retreat floor 1F or 12F to be prevented. At Step S41, one car responds to the call on the terminal floor side. In a case where the call on the terminal floor side is a car call, the processing proceeds from S42 to S43 and one car comes to a retreat state on the floor of the response. That is, because one car is in retreat in the priority zone, it is unnecessary for this car to return to the retreat floor 1F or 12F. FIG. 6(*e*) falls under this case.

In a case where at Step S39, neither a hall call or a car call occurs on the terminal floor side, one car responds to the virtual hall call at Step S44 and is in retreat on the retreat floor 1F or 12F at Step S45. FIG. 6(*d*) falls under this case.

Next, the setting of a change of the retreat floor associated with an entry to the priority zone UPZ or DPZ of a counterpart car will be described on the basis of FIG. 8.

Figure 8:
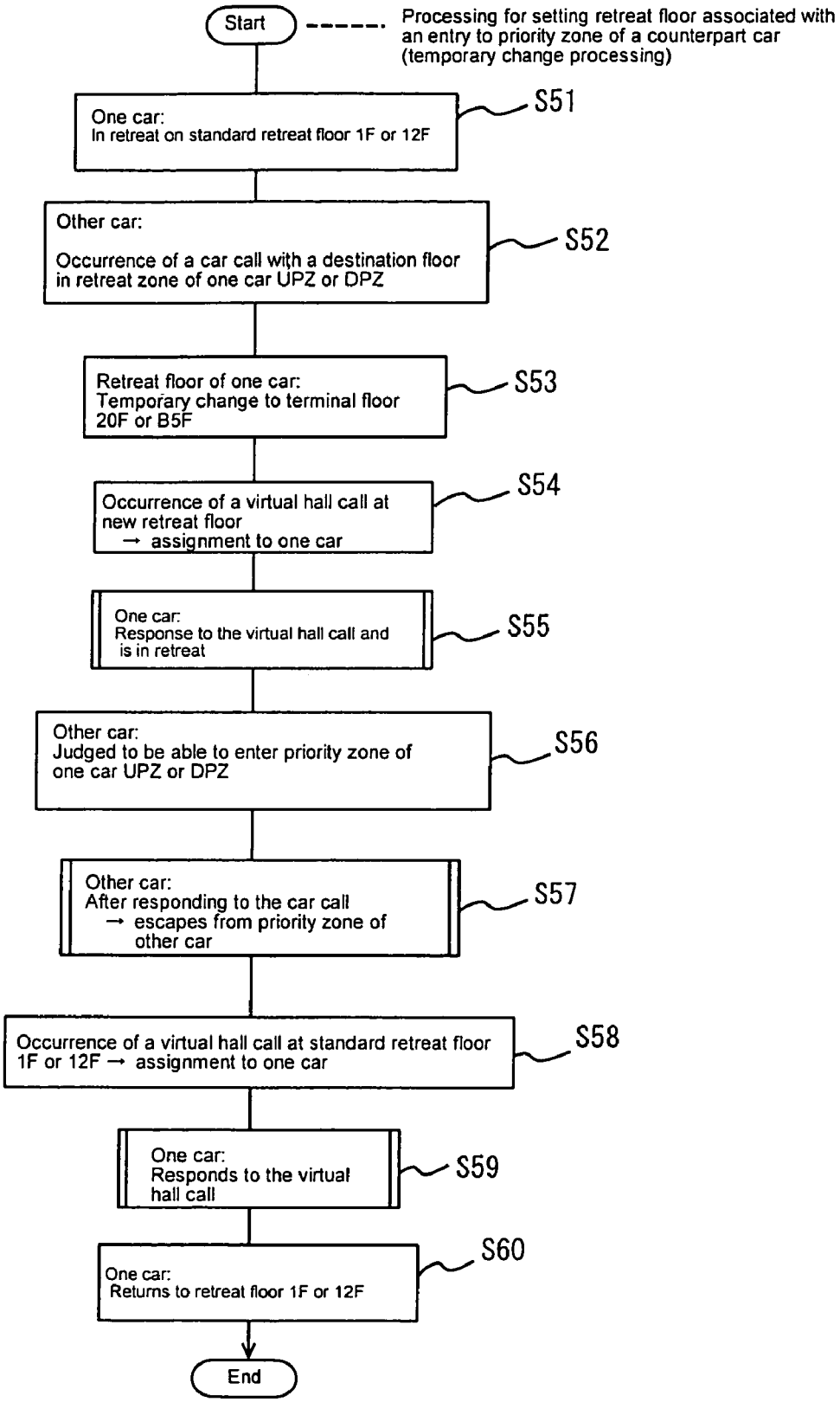
FIG. 8 is a flow chart showing the procedure for the operation of retreat floor setting related to the first embodiment of the present invention.

FIG. 8 is a flow chart showing the procedure for the operation of retreat floor setting. At Step S51, it is assumed that one car is in retreat on the standard retreat floor 1F or 12F. At Step S52, it is assumed that a car call with a service floor within the priority zone UPZ or DPZ of one car has been registered in the other car. That is, the car call C24 or C33 of FIG. 4(*c*) falls under this case. At Step S53, the retreat floor of one car is temporarily changed to the highest floor 20F or the lowest floor B5F. At Step S54, a virtual hall call is caused to occur on the new retreat floor 20F or B5F and one car is assigned. At Step S55, one car responds to the virtual hall call and is in retreat on the new retreat floor 20F or B5F. At Step S56, it is judged that the other car can enter the priority zone UPZ or DPZ of the counterpart car. At Step S57, the counterpart car enters the priority zone UPZ or DPZ of one car and responds to the car call, and after that the counterpart car escapes from the above-described priority zone UPZ or DPZ. This escape is as shown in FIG. 4(*c*) or 4(*d*). At Step S58, a virtual hall call is caused to occur on the standard retreat floor 1F or 12F and is assigned to one car. One car responds to the above-described virtual hall call at Step S59 and returns to the standard retreat floor 1F or 12F so as to be in retreat in Step S60.

As described above, according to the above first embodiment, high transportation efficiency can be exhibited by avoiding interference, because the floors are classified as the upper-car priority zone UPZ, the lower-car priority zone DPZ and the common-use zone CZ, and the upper car 5U and the lower car 5D are brought into service in a sharing manner.

Also, in the case of service in the common-use zone CZ, an entry is permitted after entry propriety is judged and hence the mutual interference of the upper car 5U and the lower car 5D can be avoided.

Furthermore, the possibility of interference of the upper car 5U and the lower car 5D is limited, because one car is caused to escape from the common-use area and to be in retreat on the retreat floor 1F, 12F after a response to a call in the common-zone CZ. Moreover, a decrease in transportation efficiency by the operation of avoiding interference can be controlled.

Second Embodiment

In this second embodiment, the common-use zone CZ in the first embodiment is added to the lower-car priority zone DPZ. Therefore, this embodiment is suitable for a building in which an equipment floor, for example, is provided between the lower-car priority zone DPZ and the upper-car priority zone UPZ, and there is scarcely any mutual traffic between the two zones.

Figure 9:
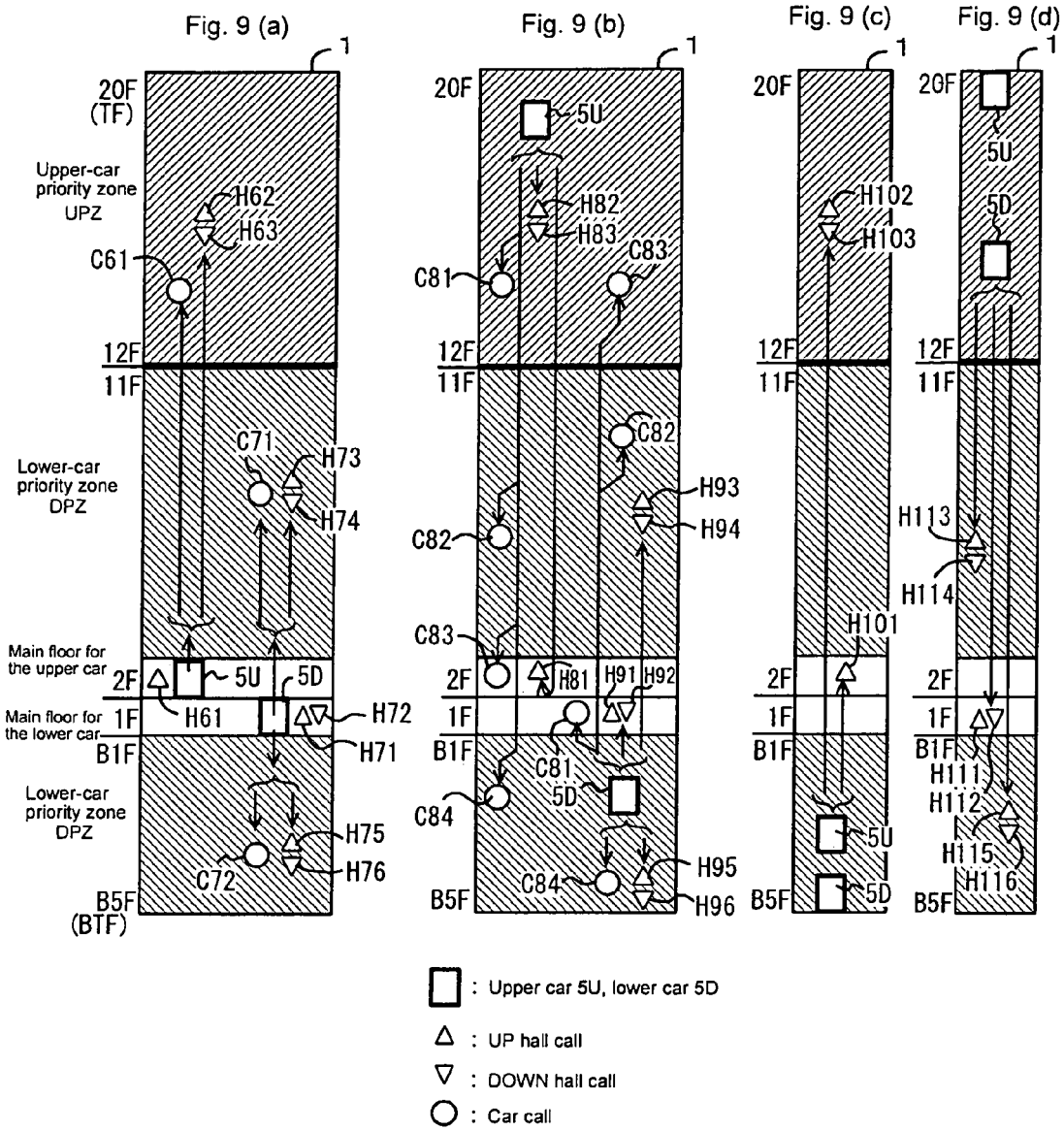
FIGS. 9(*a*) to 9(*d*) are explanatory diagrams showing the operation of the upper car and the lower car of a preferred apparatus for elevator group control related to the second embodiment of the present invention.
Figure 11:
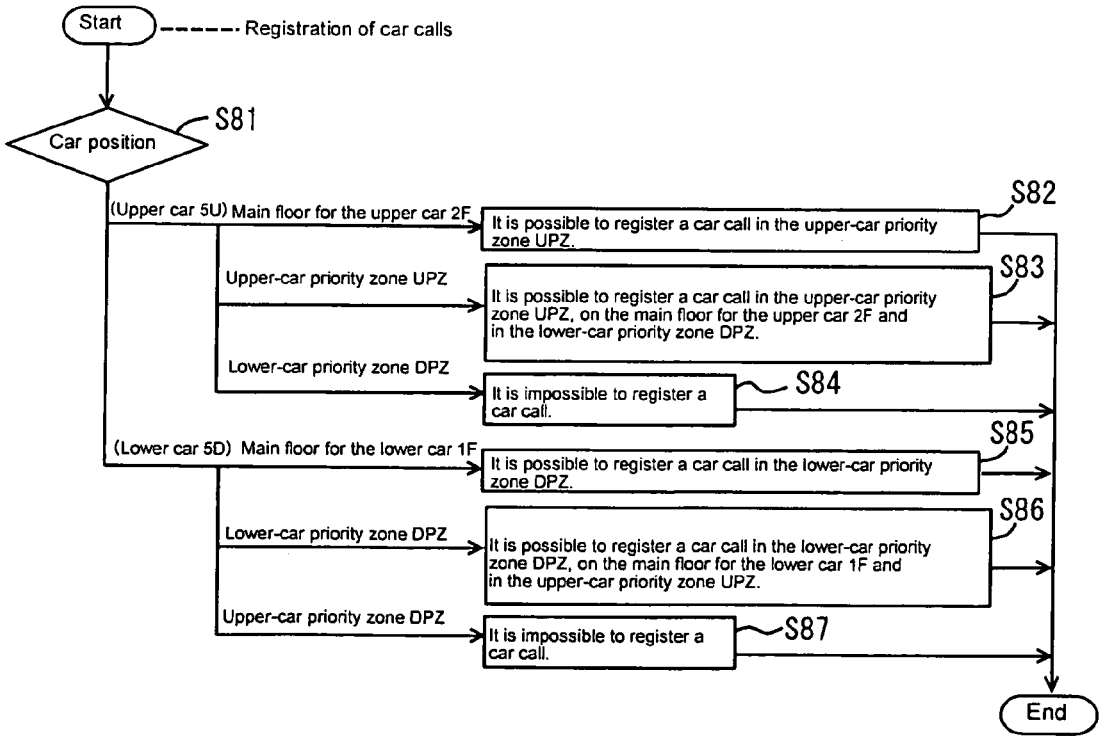
FIG. 11 is a flow chart showing the operation of registering car calls.

FIGS. 9(*a*) to 9(*d*) to FIG. 11 show a preferred apparatus for elevator group control related to the second embodiment of the present invention.

Incidentally, the configuration of the apparatus for elevator group control shown in FIG. 1 and the control circuit of the apparatus for elevator group control shown in FIG. 2 are used as they are.

FIGS. 9(*a*) to 9(*d*) are explanatory diagrams showing the operation of the upper car 5U and the lower car 5D and the common-use zone CZ of FIGS. 4(*a*) to 4(*d*) is added to the lower-car priority zone DPZ. Therefore, with the exception that UP hall calls on the third floor 3F to the 10th floor 10F (H73, H93 and H113 of FIGS. 9(*a*) to 9(*d*)) are also assigned to the lower car 5D, other points are the same as FIGS. 4(*a*) to 4(*d*), and hence the description is omitted.

Figure 10:
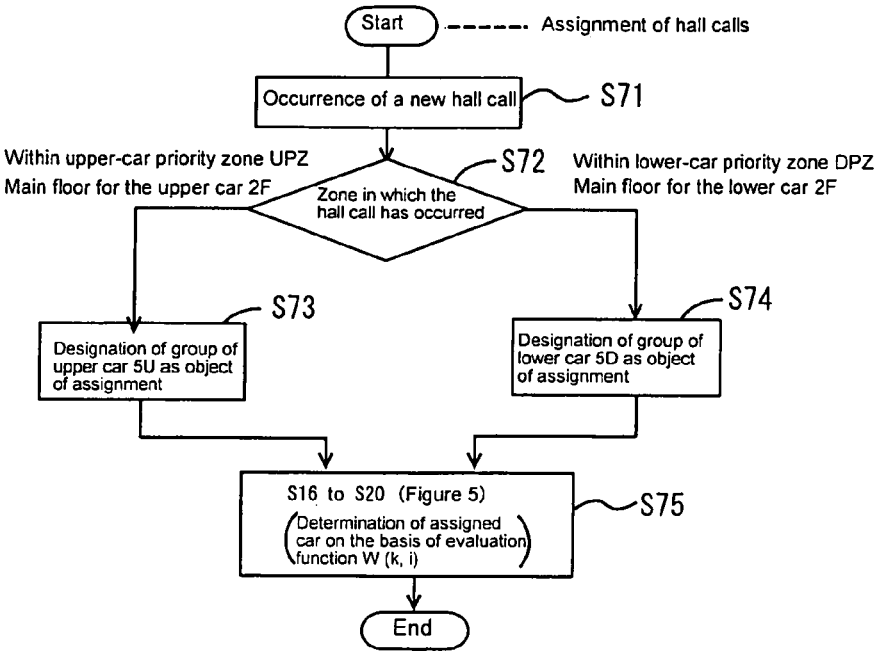
FIG. 10 is a flow chart showing the procedure for the operation of hall calls related to the second embodiment of the present invention.

Next, the operation of assigning hall calls will be described below with reference to FIG. 10.

At Step S71, it is assumed that a new hall call has occurred. At Step S72, in a case where the hall call belongs to the upper-car priority zone UPZ or the main floor 2F for the upper car, the processing proceeds to Step S73 and the group of the upper car 5U is designated as the object of assignment.

At Step S72, in a case where the hall call belongs to the lower-car priority zone DPZ or the main floor for the lower car 1F, the processing proceeds to Step S74 and the group of the lower car 5D is designated as the object of assignment.

At Step S75, the processing for assignment is executed. In this assignment, in accordance with the processing at Step S16 to Step S20 shown in FIG. 5, a selection is made from the cars as the object of assignment from the group of the upper car 5U or the group of the lower car 5D designated as the object of assignment.

Next, the operation of registering car calls will be described below with reference to FIG. 11. This figure is a flow chart showing the operation of the upper-car operation controlling means 27U1 to 27Un or the lower-car operation controlling means 27D1 to 27Dn shown in FIG. 2.

At Step S81, car positions are identified.

(1) In the Case of the Upper Car 5U

At Step S81, in a case where the upper car 5U is recognized to be on the main floor for the upper car 2F, the processing proceeds to Step S82 and it is possible to register a car call in the upper-car priority zone UPZ.

In a case where the upper car 5U is recognized to be in the upper-car priority zone UPZ, the processing proceeds to Step S83 and it is possible to register a car call in the upper-car priority zone UPZ on the main floor for the upper car 2F and in the lower-car priority zone DPZ. This is because it is ensured that passengers can go to each floor from the upper-car priority zone UPZ without changing cars.

In a case where the upper car 5U is recognized to be in the lower-car priority zone DPZ, the processing proceeds to Step S84 and it is impossible to register a car call. This is because the upper car 5U is caused to escape rapidly from the lower-car priority zone DPZ. Therefore, the upper car 5U either receives retreat instructions or escapes from the lower-car priority zone DPZ after the assignment of a hall call.

(2) In the Case of the Lower Car 5D

Similarly, in a case where at Step S81 the lower car 5D is recognized to be on the main floor for the lower car 1F, the processing proceeds to Step S85 and it is possible to register a car call in the lower-car priority zone DPZ.

In a case where the lower car 5D is recognized to be in the lower-car priority zone DPZ, the processing proceeds to Step S86 and it is possible to register a car call in the lower-car priority zone DPZ, on the main floor for the lower car 1F and in the upper-car priority zone UPZ.

In a case where the lower car 5D is recognized to be in the upper-car priority zone UPZ, the processing proceeds to Step S87 and it is impossible to register a car call. Therefore, the lower car 5D either receives retreat instructions or escapes from the upper-car priority zone UPZ after the assignment of a hall call.

According to the above-described second embodiment, each floor belongs either to the upper car 5U or to the lower car 5D and, therefore, it is possible to further reduce mutual interference.

In the above-described first and second embodiments, classification of the floors is performed in such a manner that the best approximation of the number of occupants in the two zones is obtained. However, the classification may be performed in such a manner that the traffic volumes on each floor are measured and the best approximation of the measured values is ensured. As a result of this, it is possible to equalize loads on the upper car and the lower car according to actual traffic volumes.

The hall button HB is such that an UP hall call and a DOWN hall call can be registered. However, the hall button HB may be a hall control panel to which buttons corresponding to each service floor like the car control panel 8U or 8D are attached. According to the hall control panel, it is possible to early get to know the destination floors of waiting passengers on each floor.

Industrial Applicability

As described above, the controller for elevator group management related to the present invention can reduce the ratio of the area of the shaft portion to the floor area of a building and improve transportation efficiency, and is suitable for high-rise buildings in which many elevators are installed.

What is claimed is:

1. An apparatus for group control of a set or a plurality of sets of elevators, each set including an upper car and a lower car disposed in a vertical relation within one elevator shaft communicating with each floor of a building, and ascending and descending independently, the apparatus comprising:

floor classifying means for classifying floors so that a floor communicating with an entrance of the building is classified as a main floor for the lower car, a floor communicating with an entrance of the building at a level higher than the main floor for the lower car is classified as a main floor for the upper car, floors from floors immediately below the main floor for the lower car to a lowest floor are classified as a lower-car priority zone, an upper half of a zone obtained by dividing into two floors from immediately above the main floor for the upper car to a highest floor is classified as an upper-car priority zone and a lower half is classified as a common-use zone;

retreat floor setting means for setting, as retreat floors, floors not impeding the operation of a counterpart car in the same elevator shaft;

assignment determining means for assigning a hall call registered on the main floor for the lower car and in the lower-car priority zone to the lower car, a hall call registered on the main floor for the upper car and in the upper-car priority zone to the upper car, and a hall call registered in the common-use zone to either of the upper car and the lower cars, according to an operating condition;

entry propriety judging means for judging entry propriety according to potential interference with a counterpart car in the same elevator shaft when the upper car enters the common-use zone or the lower-car priority zone, or when the lower car enters the common-use zone or the upper-car priority zone; and retreat instruction means for giving instructions to retreat to the upper car or the lower car, the upper car or the lower car having made entry according to a judgment result of said entry propriety judging means, wherein, in accordance with judgment results of said entry propriety judging means, the upper car or the lower car having been assigned hall calls by said assignment determining means, the upper car or the lower car is brought into retreat in accordance with an instruction of said retreat instruction means.

2. The apparatus for elevator group control according to claim 1, wherein said floor classifying means performs classification so that a best approximation is obtained between number of occupants belonging to the upper-car priority zone and number of occupants belonging to the common-use zone.

3. The apparatus for elevator group control according to claim 1, wherein said floor classifying means measures traffic volume of the upper-car priority zone and traffic volume of the common-use zone and performs classification so that a best approximation to the traffic volumes measured is obtained.

4. The apparatus for elevator group control according to claim 1, wherein said retreat floor setting means sets the main floor for the lower car as a retreat floor of the lower car and sets the lowest floor of the upper-car priority zone as a retreat floor of the upper car, and said retreat instruction means causes a virtual hall call to occur on the retreat floor and gives retreat instructions by assigning the virtual hall call to the upper car or the lower car.

5. The apparatus for elevator group control according to claim 2, wherein, when a hall call registered on a retreat floor or on a floor nearer to a terminal floor than to the retreat floor is assigned to the upper car or the lower car to which a virtual hall call has been assigned, or when a car call is registered with the retreat floor or a floor nearer to the terminal floor than to the retreat floor serving as a service floor, the virtual hall call is cancelled.

6. The apparatus for elevator group control according to claim 1, wherein said retreat floor setting means sets the lowest floor as a retreat floor for the lower car when a car call with the lower-car priority zone serving as a service floor has been registered for the upper car, and sets the highest floor as a retreat floor for the upper car when a car call with the upper-car priority zone serving as a service floor has been registered for the lower car, and said retreat instruction means causes a virtual hall call to occur on the retreat floor which has been newly set and gives retreat instructions by assigning the virtual hall call to the upper car or the lower car.

7. An apparatus for group management of a set or a plurality of sets of elevators, each set consisting of an upper car and a lower car which are disposed in a vertical relation within one elevator shaft communicating with each floor of a building and which ascend and descend independently, the apparatus comprising:

floor classifying means for classifying floors so that a floor communicating with an entrance of the building is classified as a main floor for the lower car, a floor communicating with an entrance of the building at a level higher than the main floor for the lower car is classified as a main floor for the upper car, an upper half of a zone obtained by dividing into two floors from immediately above the main floor for the upper car to the highest floor is classified as an upper-car priority zone, and floors from a floor immediately below the main floor for the lower car to the lowest floor are classified as a lower-car priority zone;

retreat floor setting means for setting, as retreat floors, floors not impeding the operation of a counterpart car in the same elevator shaft;

assignment determining means for assigning a hall call registered on the main floor for the lower car and in the lower-car priority zone to the lower car, and a hall call registered on the main floor for the upper car and in the upper-car priority zone to the upper car;

entry propriety judging means for judging entry propriety according to potential interference with a counterpart car in the same elevator shaft when the upper car enters the lower-car priority zone or the lower-car priority zone, or when the lower car enters the upper-car priority zone; and retreat instruction means for giving instructions to retreat to the upper car or the lower car, the upper car or the lower car having made entry according to a judgment result of said entry propriety judging means, wherein, in accordance with judgment results of said entry propriety judging means, the upper car or the lower car having been assigned hall calls by said assignment determining means, the upper car or the lower car is brought into retreat in accordance with the instruction of said retreat instruction means.

* * * * *